US007855661B2

(12) United States Patent
Ponert

(10) Patent No.: US 7,855,661 B2
(45) Date of Patent: Dec. 21, 2010

(54) APPARATUS FOR MONITORING INDIVIDUAL PARKING POSITIONS

(75) Inventor: Gregor Ponert, Salzburg (AT)

(73) Assignee: Skidata AG, Grodig/Salzburg (AT)

( * ) Notice: Subject to any disclaimer, the term of this patent is extended or adjusted under 35 U.S.C. 154(b) by 278 days.

(21) Appl. No.: 12/109,514

(22) Filed: Apr. 25, 2008

(65) Prior Publication Data

US 2008/0266138 A1 Oct. 30, 2008

(30) Foreign Application Priority Data

Apr. 26, 2007 (EP) ..... 07008485

(51) Int. Cl.
*G08G 1/00* (2006.01)

(52) U.S. Cl. ..... 340/932.2; 340/933; 340/935; 340/943; 340/993; 455/63.4; 455/552.1; 455/553.1

(58) Field of Classification Search ..... 340/932.2–935, 340/941–943; 455/63.4, 552.1, 553.1
See application file for complete search history.

(56) References Cited

U.S. PATENT DOCUMENTS 3,376,547 A * 4/1968 Auer, Jr. ..... 340/932.2
4,071,845 A * 1/1978 Gross ..... 342/433
4,075,633 A * 2/1978 Lewis ..... 342/381
4,126,854 A * 11/1978 Sheridon ..... 345/107
5,088,073 A 2/1992 Speas
5,432,508 A * 7/1995 Jackson ..... 340/932.2
5,504,314 A * 4/1996 Farmont ..... 235/384
6,107,942 A * 8/2000 Yoo et al. ..... 340/932.2
6,147,624 A * 11/2000 Clapper ..... 340/932.2
6,184,789 B1 * 2/2001 Richley et al. ..... 340/571
6,340,935 B1 * 1/2002 Hall ..... 340/932.2
6,650,250 B2 * 11/2003 Muraki ..... 340/932.2
6,885,311 B2 * 4/2005 Howard et al. ..... 340/932.2
6,917,307 B2 * 7/2005 Li ..... 340/932.2
7,099,697 B2 * 8/2006 Okawa et al. ..... 455/562.1
7,317,898 B2 * 1/2008 Tegreene ..... 455/63.4
7,394,509 B2 * 7/2008 Sage ..... 349/86

FOREIGN PATENT DOCUMENTS

DE 20 2006 015 787 U1 4/2007
WO 02/063570 A2 8/2002

* cited by examiner

*Primary Examiner*—Daniel Wu
*Assistant Examiner*—Son M Tang
(74) *Attorney, Agent, or Firm*—Davis & Bujold, P.L.L.C.

(57) ABSTRACT

Apparatus for the individual monitoring of parking positions of a parking facility comprises a sensor (9) for vehicle detection and optical indicator means (5) for indicating the occupied/free status of a parking position (4). Sensor (9) has a transmit aerial (10) to radio the occupied/free status of parking position (4) to the parking facility control center. The optical indicator means (5) comprises a bistable indicating element.

12 Claims, 2 Drawing Sheets

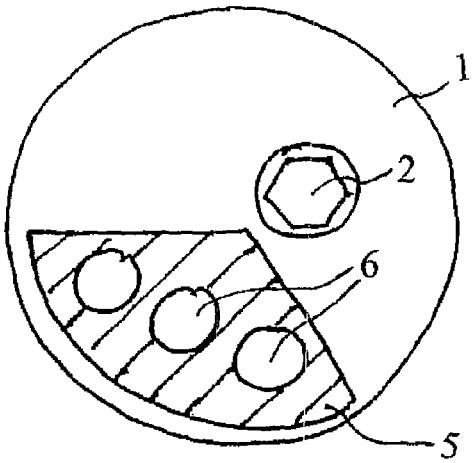
Fig. 1
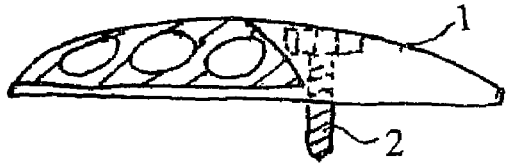
Fig. 2
Fig. 3
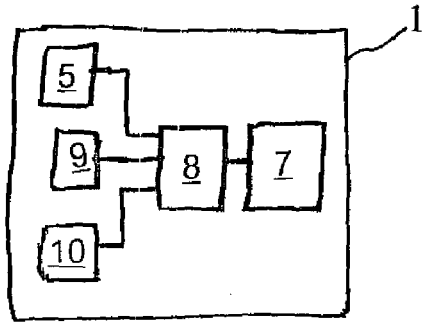
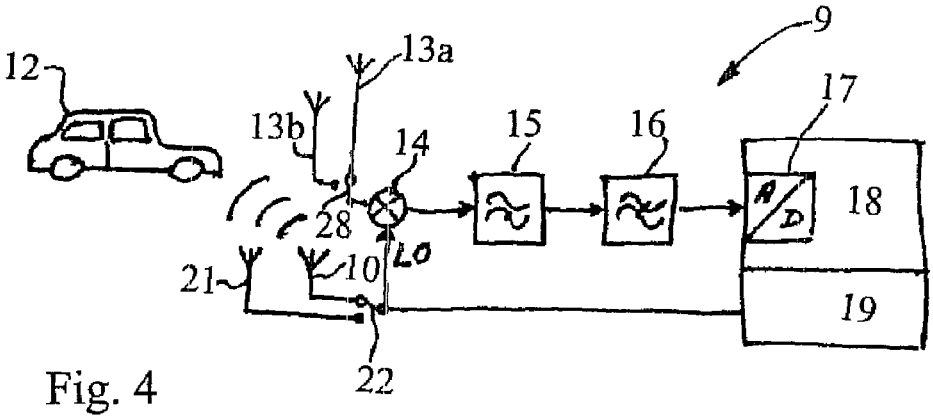
Fig. 4

Fig. 5
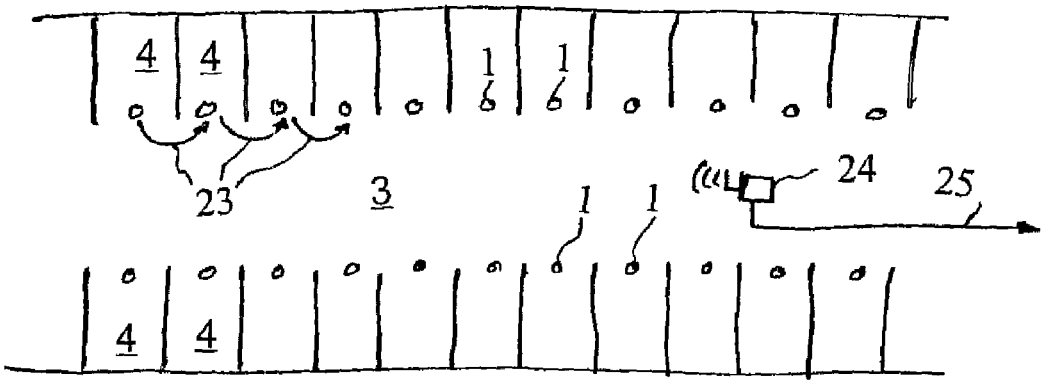
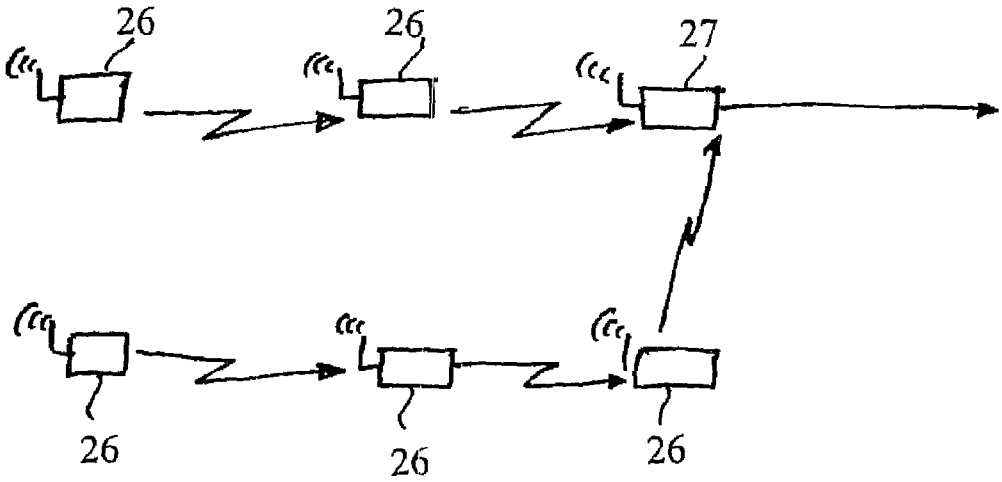
Fig. 6

APPARATUS FOR MONITORING INDIVIDUAL PARKING POSITIONS

This application claims priority from European Application Serial No. 07008485.0 filed Apr. 26, 2007.

FIELD OF THE INVENTION

The invention relates to an apparatus for monitoring individual parking positions in accordance with the pre-characterizing portion of patent claim 1.

BACKGROUND OF THE INVENTION

The monitoring of individual parking positions in in-door car parks or public traffic spaces presently uses cable-linked sensors for vehicle detection, the common practice being the use of ultrasonic, infrared or geomagnetic field sensors. Optical indication is effected by cable-linked lights or light emitting diodes as well. The cable links are needed because of the high energy consumption of the sensors and the optical indicator elements. Likewise, cables are used for transmitting occupied/free data relating to each parking position to a network connected to the parking facility control center. The cabling of the prior individual parking position monitoring devices necessitates considerable capital outlays especially if retrofitted. The cost of laying the cables may far exceed that of the sensors and the optical indicators themselves.

SUMMARY OF THE INVENTION

An object of the invention is to provide an individual parking position monitoring system which is inexpensive to install.

In accordance with the invention, each vehicle detection sensor has a transmit aerial for communicating the occupancy status of the respective parking position by radio to the central control system of a facility such as an in-door car park. This obviates a data transmission cable link from the sensor.

Also, in accordance with the invention, the optical indicator means comprises a bistable indicating element, whereby the display is controlled only in response to change in status. This results in considerable energy savings, whereby the sensor and the optical indicator may be operated on a (dry-cell or chargeable) battery for several years. Apart from a dry-cell battery, it would be possible to use a photovoltaic module including a chargeable battery or a storage capacitor, said module receiving daylight and/or being lit by the headlights of the motor vehicles in the car park or other parking facility.

In accordance with the invention, this obviates the high cost of laying cables. Rather, the sensor and the optical indicator—both preferably in a casing—may be mounted in a simple manner e.g. by bolting or bonding onto the pavement surface of the parking lot or overhead onto a ceiling there above.

The sensor and the optical indicator may each be provided with a casing of its own. Preferably, the sensor and the optical indicator are disposed in the same casing, which will further reduce the cost of installation.

The bistable indicator element preferably comprises a so-called "flip dot", i.e. an electro mechanical component including tilt or rotation means and controlled to show one of two optically differing sides of an indicator platelet. To this end, the platelet may be mounted for rotation on the casing. The two sides of the platelet may differ in color, such as one red and the other green. The platelet may have a permanent magnet mounted to the rear surface thereof, with a solenoid disposed there behind to exert a polarity-dependent force on the platelet so as to swing it over. Snap-type locking means is provided to prevent the indicator platelet from pivoting back when the solenoid is disabled. As a result, the indicator platelet has two stable conditions, whereby energy is needed only for rotating it. No such energy needs to be expended as long as the indication remains constant.

The indicator platelet may be fluorescing or reflecting—such as a retro reflector, i.e. comprising prism-shaped surface elements of glass on at least one side thereof. If struck by light from vehicle headlights, the prisms will refract the impinging light and retro reflect it with a brightness sufficient to create the impression of being an independent light source.

Additional energy savings are obtainable by the sensor being configured for intermittent activation for vehicle detection and/or radio transmission.

In addition to the transmit aerial, the sensor has a receive aerial.

Differences between the signal received by the receive aerial and the signal transmitted by the transmit aerial may be evaluated to detect vehicle movements to so perform vehicle detection. Such differences may be amplitude, phase and/or frequency differences—such as frequency shifts due to the Doppler effect. As a result, the sensor may essentially comprise the receive and transmit aerials, a mixer, a transceiver, and a micro controller so that it may be very simple in structure and be assembled on a single printed wiring board. However, the sensor may be configured for vehicle detection by evaluating reflected signals.

The transmit aerial may be used also for transmitting the occupied/free status of a single parking position by radio to the car park control center.

To this end, radio transmission from a sensor's transmit aerial to the receive aerial of a neighboring sensor or of a base station may take place in an in-door car park e.g. on the story thereof which is linked to the parking facility control center via a local network (LAN).

Instead, radio transmission may take place from the transmit aerials of plural sensors to a base station and from there to the next base station and further on to a master base station connected to the parking facility control center by means such as a LAN. The base station or stations or the master base station may be mounted to the ceiling or to a wall of the in-door car park or of the respective story and be powered by electric lighting mounted on that ceiling or wall.

In case the transmit and/or the receive aerial of the sensor are directional, radio transmission may be by a non-directional aerial, with the sensor feeding, or being fed from, the directional and the non-directional aerials alternatingly.

The sensor used for vehicle detection may be a geomagnetic field sensor, an ultrasonic sensor or an infrared sensor as well.

BRIEF DESCRIPTION OF THE DRAWINGS

An exemplary embodiment of the inventive apparatus is illustrated below under reference to the attached drawing.

FIGS. 1 and 2 are plan and side views, respectively, of a casing holding the components of the inventive apparatus;

FIG. 3 shows a block diagram of the single parking position monitoring apparatus;

FIG. 4 shows a block diagram of a sensor;

FIG. 5 schematically shows in plan view a parking facility comprising multiple individual parking positions; and FIG. 6 schematically shows an assembly comprising base stations for radioing the occupancy status to the parking space control center by means of sensor transmit aerials.

DETAILED DESCRIPTION OF THE DRAWINGS

As shown in FIGS. 1 and 2, the components of the individual parking position monitoring apparatus are disposed in a sturdy casing 1 impenetrable to water and dust and bolted e.g. to the pavement of single parking position 4 (FIG. 4) by means of a threaded fastener 2.

The shallow domed casing 1 is circular in plan and has at the side facing the access area 3 to the individual parking position 4 (FIG. 4) optical indicator means 5 in the form of indicator platelets 6 formed of flip dots.

According to FIG. 3, casing 1 accommodates a power supply 7 such as a dry cell and connected through energy savings means 8 with sensor 9, optical indicator means 5 and a transmit aerial 10 for radioing the occupied/free status. Energy saving means 8 is used e.g. for activating sensor 9 and radio transmit aerial 10 in intervals only.

As shown in FIG. 4, sensor 9 serves to detect a vehicle 12 by its movement into or away from parking position 4, such movement being detected by virtue of the Doppler effect.

To this end, a receive aerial 13*a* is used in addition to transmit aerial 10, with the frequency of transmit aerial 10 being combined with that of receive aerial 13*a* in a mixer 14. The signal from mixer 14 is AC coupled at 15 and via a low-pass filter 16 to A/D transducer 17 included in transceiver 18 and then to micro controller 19, which feed transmit aerial 10 at the same time. If transmit aerial 10 is directional, an additional non-directional aerial 21 may be provided, with directional and non-directional aerials 10, 21 fed alternatingly through a switch 22. If receive aerial 13*a* is directional, an additional non-directional or directional aerial 13*b* may be provided as a receive aerial, with aerials 13*a*, 13*b* being connected to the unit alternatingly by means of a switch 28.

As shown in FIG. 5, a parking area has individual parking positions on the left and rights sides of a roadway forming access area 3. Each individual parking position 4 has mounted at the side facing access area 3 a casing 1 holding the inventive apparatus. As shown by arrows 23, radioing the occupied/free status of each individual parking position 4 is effected by means of transmit aerials 10, 21 of sensors 9 inside casings 1 from one parking position 4 to the next and then to a base station 24 connected to the parking facility control center by a data cable 25 (not shown).

In the embodiment shown in FIG. 6, radio transmission is from transmit aerials 10, 21 of the individual parking positions 4 to a base station 26 and via the next base station 26 to a master base station 27 connected to the car park control center. That is, base stations 26 pick up the information from sensors 9 and conduct it via a suitable radio network to the car park control center. The network is formed by an arrangement of base stations 26 which route the information to master base station 27.

The invention claimed is:

1. An apparatus for monitoring individual parking positions of a parking area, the apparatus comprising:

a sensor (9) for vehicle detection, optical indicator means (5) for indicating an occupied/free status, the sensor (9) comprising a transmit aerial (10, 21) for radio transmitting the occupied/free status of an individual parking position (14) to a parking facility control center, the optical indicator means (5) including at least one bistable indicator element, and at least one of the transmit aerial (10) and a receive aerial (13*a*) are directional and an additional non-directional aerial (21, 13*b*) is provided, and the at least one transmit aerial (10) which is directional and the additional non-directional aerial (21, 13*b*) are switched to operate alternatively.

2. The apparatus according to claim 1, wherein the sensor (9) and the optical indicating means (5) are disposed in a casing (1) adapted to be mounted on one of a roadway pavement and at an overhead location.

3. The apparatus according to claim 1, wherein at least one of a dry-cell battery (7), a chargeable battery and a photovoltaic module supplies power to the sensor (9) and the optical indicator means (5).

4. The apparatus according to claim 1, wherein the sensor (9) is intermittently activatable for at least one of vehicle detection and radio transmission.

5. The apparatus according to claim 1, wherein the bistable indicator element comprises an indicator platelet (6) which has optically differing side surfaces and is mounted for rotation.

6. The apparatus according to claim 5, wherein at least one side surface of the indicator platelet (6) is formed to fluoresce and reflect light.

7. The apparatus according to claim 5, wherein the sensor (9) comprises the receive aerial (13*a*) and detects movement of a vehicle (12) from differences of a signal picked up by the receive aerial (13) from the signal transmitted by the transmit aerial (10, 21).

8. The apparatus according to claim 7, wherein the sensor (9) comprises a mixer (14), a transceiver (18) and a microcontroller (19).

9. The apparatus according to claim 7, wherein the transmit aerial (10, 21) transmits the occupied/free status of the individual parking position, by radio, to at least one base station (24, 26) connected to the parking lot control center.

10. The apparatus according to claim 5, wherein the sensor is configured to detect reflexion of a signal thereby monitoring a vehicle.

11. The apparatus according to claim 1, wherein the sensor (9) comprises one of a geomagnetic field sensor, an ultrasonic sensor and an infrared sensor.

12. An apparatus for monitoring individual parking positions of a parking area, the apparatus comprising a sensor (9) for vehicle detection;

optical indicator means 5 for indicating occupied/free status the sensor (9) comprising a transmit aerial (10, 21) for radio transmitting the occupied/free status of an individual parking position (14) to a parking facility control center;

the optical indicator means (5) including at least one bistable indicator element;

the bistable indicator element comprising an indicator platelet (6) havings optically differing side surfaces and being mounted for rotation;

the sensor (9), comprises a receive aerial (13*a*), for detecting movement of a vehicle (12) from differences of a signal picked up by the receive aerial (13) from the signal transmitted by the transmit aerial (10, 21); and at least one of the transmit aerial (10) and the receive aerial (13*a*) are directional and an additional non-directional aerial (21, 13*b*) is provided, and the at least one transmit aerial OM, which is directional, and the additional non-directional aerial (21, 13*b*) are switched to operate alternatively.

* * * * *